United States Patent [19]

Bailey

[11] Patent Number: 4,879,842

[45] Date of Patent: Nov. 14, 1989

[54] EMERGENCY WINDOW SYSTEM

[75] Inventor: Frank Bailey, Burnley, England

[73] Assignee: Magnet PLC, Keighley, England

[21] Appl. No.: 308,016

[22] Filed: Feb. 9, 1989

[30] Foreign Application Priority Data

Feb. 16, 1988 [GB] United Kingdom ..... 8803571

[51] Int. Cl.[4] ..... E05B 65/10

[52] U.S. Cl. ..... 49/141; 49/379

[58] Field of Search ..... 49/141, 379

[56] References Cited

U.S. PATENT DOCUMENTS 4,208,840 6/1980 Jentoft et al. ..... 49/379

4,237,654 12/1980 Landem et al. ..... 49/141

4,445,589 5/1984 Longenecker ..... 49/141 X

*Primary Examiner*—Philip C. Kannan

*Attorney, Agent, or Firm*—Larson and Taylor

[57] ABSTRACT

The invention concerns a window specially designed for emergency use. The window comprises a fixed outer frame (1) and a sash (2) mounted for normal horizontal pivoting movement between open and closed positions about axis Y—Y. Two arms (3) extend in the respective side rebates between the frame (1) and sash (2), and opposed horizontal pivots (6) are secured to the sash (2) and the arms (3) for such normal pivoting movement of the sash (2). Each arm (3) is connected to the top (1*a*) of the frame (1) by a hinge (4) and each arm is acted on by a respective telescopic gas spring (5) confined within the rebate but acting on the associated arm (3) to urge it outwardly of the frame (1). For normal opening and closing movement of the sash (2) for which a casement fastener (7) is fitted, the arms (3) are retained secured to the frame (1) by a catch arrangement that is operable manually by a control handle (8) separate to the fastener (7). For emergency opening of the window, the control handle (8) is actuated and the catch means is released to disengage the lower ends of the arms (3) so that the forces applied by the gas springs (5) act on the arms (3) causing the arms to move outwardly of the frame (1) about the hinge axis Z—Z carrying the sash (2) outwardly clear of the opening of the frame (1) for emergency access. Special features for automatic re-engagement of the catch means and control of the system are described in detail. The invention has particular application for roof windows.

10 Claims, 6 Drawing Sheets

EMERGENCY WINDOW SYSTEM

This invention relates to windows and is particularly concerned with a window system that can be used in an emergency, such as for fire or escape from a building.

BACKGROUND OF THE INVENTION

One special application of this invention is for windows that are installed in roofs, such as for loft or attic conversions, and where it is required under Statutory Regulations or Codes of Practice that a means of escape for an emergency be provided from such room.

It is already known to provide windows of the type in which there is a fixed outer frame that is secured to the structure and which fixed frame mounts a glazed sash for pivotal movement by means of pivot hinges defining a horizontal axis about which the sash pivots relative to the frame. Commonly such pivot hinges are known as horizontal pivots, and there are many kinds of such pivots which are designed for particular uses and styles of windows.

Typically, such horizontal pivots may incorporate devices to limit pivotal movement so that the sash can be held or secured in a vent position and cannot be fully opened until the device is released. In addition, some horizontal pivots are designed, in conjunction with design of the sash and fixed frame, to provide for an extended range of pivotal movement to enable the sash to be reversed for cleaning.

Irrespective of the wide range of types of such horizontal pivots, they are all designed to support the sash for such horizontal pivoting movement about the horizontal axis which extends substantially across the middle of the glazed sash. Thus, even when the sash is fully open or reversed, the opening through the structure defined by the fixed outer frame is obstructed by the glazed sash, and such opening will not fulfill the requirements for an emergency or escape access from the building.

It is already known to provide horizontal pivots in which the pivot assembly has two main parts respectively secured to the frame and the sash, and these parts can be separated so as to uncouple them to permit removal of the sash from the fixed frame. Various types of these pivots are known and are commonly called sash lift-off pivots. As will be appreciated, although such lift-off pivots permit the fixed frame to be revealed as an open access opening by removal of the sash, such method of providing an access opening is not suitable for emergncy or escape purposes. These lift-off pivots are designed for window systems only to facilitate maintenance and any re-glazing, and the sash is removed inwardly of the fixed frame into the structure. Thus, such lift-off pivots are not suitable for escape or emergency requirements where a full outward opening is required by a simple operation of some suitable actuator.

SUMMARY OF THE INVENTION

It is an object of this invention to provide a window system of the horizontal pivot kind and in which a simple operable mechanism is provided to provide an open access through the fixed frame of the window.

It is a further object of this invention to provide an emergency escape window suitable for installation in roofs.

It is another object of this invention to provide a window system combining a horizontal pivot window with emergency escape means which is unobtrusive and which does not interfere with normal operating modes of the horizontal pivot for the sash.

Other objectives of this invention will be understood and explained from the description later herein of a preferred embodiment of the invented window system.

According to this invention, we provide a window comprising an outer frame for securing to a structure, a sash mounted by opposed pivot means for pivotal movement about a horizontal axis relative to the outer frame, the horizontal pivot axis lying intermediate the top and bottom of the outer frame, two opposed arms supported from the top of the outer frame with each arm extending alongside a respective side member of the outer frame for confinement within the rebate between the outer frame and the sash when the sash is closed, each arm being supported at its upper end by a hinge mounted on the outer frame with spring means acting between the outer frame and the arms to urge the arms in a direction outwards of the outer frame, a retainer mounted on the outer frame for engagement with catch means on the lower end of an arm to retain the arms alongside the respective side member of the outer frame against the force of the spring means to preclude pivotal movement of the arms about their respective hinges, said opposed horizontal pivot means being connected to the sash and to the arms so that when the retainer is so engaged with the catch means the sash can be opened and closed relative to the outer frame in a normal mode pivoting about the intermediate horizontal axis, and an actuator mounted on the sash for disengaging the catch means from the retainer whereby the arms are released for hinged movement about their upper ends under the force of the spring means to displace the arms with the sash outwardly clear of the opening in the outer frame in which the sash seats when in the closed position.

By this invention, the access opening for emergency or escape is provided by the opening in the outer frame from which the sash is lifted clear by hinging movement of the arms which support the sash and which are arranged to be released by an actuator for emergency or escape function of the window. In the normal mode of use of such window the sash can be opened and closed relative to the outer frame in the usual manner by means of the conventional horizontal pivot means which, instead of being secured to the outer frame, are secured to the arms. For normal mode use of the window, the arms are retained alongside the rebate sides of the outer frame and the arms cannot move. This invented window therefor provides a very convenient and unobtrusive form of emergency escape window whilst maintaining the conventional performance of a standard window of the horizontal pivot kind.

Preferably, the spring means acting on the arms is a telescopic gas spring which is confined within the rebate between the outer frame and the sash and which gas spring when extended, provides an elongate strut assembly for supporting the arms and the sash.

The use of a gas spring enables selection of the gas spring force in relation to the reaction load of the glazed sash. By appropriate selection of the gas spring force, the same modular components can be used for a range of sizes of windows and different glazed weights of sash within compensation limits. Typically, such compensation is required to accommodate different materials as might be used for the sash, and for the type of glazing. Examples include timber, aluminium or UPVC for the sash, and single, double or triple glazing units and possibly accessories such as blinds or screens to be mounted on the sash.

The invented window may be used in a large number of installation locations in a structure, such as for inclined windows as used in pitched roofs or in a vertical wall. In any of these installation locations, the sash is arranged to be projected outwardly and to be lifted upwardly relative to the outer frame automatically under the action of the spring means once the actuator has been operated to release the catch means from the retainer.

In known manner, the window may be provided with cills, flashings or casings in cassette form for weathering and style or design requirements can be incorporated without detracting from the special inventive features as explained herein.

The horizontal pivot means for mounting the sash on the arms can be of any suitable type having fixing or securing backets for fitting respectively to the sash and the arms. Preferably, such horizontal pivot means would be arranged, in known manner, to limit full opening movement of the sash and to retain the sash in a vent position, as well as providing for reversal of the sash for cleaning purposes. Such horizontal pivot means are outside the scope of this invention and there are many suitable known and conventional types and designs.

Preferably, each of the arms is arranged to extend the full length of each respective rebate, and each arm has associated catch means for engagement with a retainer mounted on the outer frame.

By such a preferred configuration, the same modular components can be used for a wide range of widths of windows, and fitting and assembly is facilitated by a symmetrical arrangement. However, it should be appreciated that this is not essential.

Conveniently, each arm is of elongate plate form of which the top end portion is connected to a hinge secured to the top of the outer frame so that the hinging axis of the arms extends horizontally aligned with the top of the outer frame.

Other arrangements of the hinge are envisaged, such as a side hinge plate connected to the top of a side member of the outer frame with a pivot pin connection to the upper portion of the adjacent arm.

Notwithstanding the arrangement and configuration chosen for the top hinge for the arms, by having the hinge axis for the arms at the top of the outer frame, then the access clearance required on displacement of the arms with the sash is maintained for the full extent of the opening in the outer frame.

The retainer on the outer frame may comprise a fixed striker plate upstanding from the outer frame and lying adjacent to the lower end of the arm. The catch means comprises a catch plate mounted on the lower end of the arm for engagement with the striker with the catch plate being arranged for releasing movement away from the striker for disengagement and release of the arm when the actuator is operated.

Conveniently, the catch plate is mounted for pivotal movement on the lower end of the arm and is spring-loaded so as to be biassed into engagement with the striker. The actuator is arranged to act on the catch plate to overcome such spring bias and to pivot the catch plate in a direction to disengage it from the striker.

By such an arrangement of striker and catch plate, the arms are held in the retained position until released, and when the sash with arms is restored into the closed position, the retainer and catch means are automatically re-engaged to retain the arms in the position for normal mode operation of the sash. This is an important practical advantage which enables the operation and access for emergency escape to be tried, tested and otherwise checked, and if there should be inadvertent operation of the actuator, the window can be returned to the normal position of use in an easy and simple manner.

The actuator mounted on the sash preferably includes a manually operable control member, such as a handle or lever. Preferably, the control member is separate from a casement fastener fitted to the window for closing and securing the sash to the outer frame when in the closed and normal position.

The manually operable control member may be especially designed to signify emergency operation and to be significantly different from the casement fasteeer used for normal mode operation and closure of the sash.

In a preferred arrangement of the actuator, there is a control shaft extending lengthwise of the bottom sash member and this control shaft is arranged for limited rotation on operation of the control member. The control shaft mounts a release abutment for engagement with the catch plate of the catch means for displacing the catch plate into the release position when the control shaft is rotated by the control member.

This preferred arrangement enables the same form of control and release abutment to be employed for a wide range of windows, and to accommodate different sizes it is only necessary to change the length of the control shaft.

The control member may include a lever handle arranged to rotate the control shaft through a drive connection comprising a cam return arrangement so that the control member and control shaft are automatically returned to the operative retaining position after operation.

Other features of this invention together with the technical advantages achieved thereby are explained later herein with reference to an exemplary embodiment of the invention.

Brief Description of Drawings

An exemplary embodiment of this invention is depicted in drawings wherein.

DETAILED DESCRIPTION OF EMBODIMENT

Figure 1:
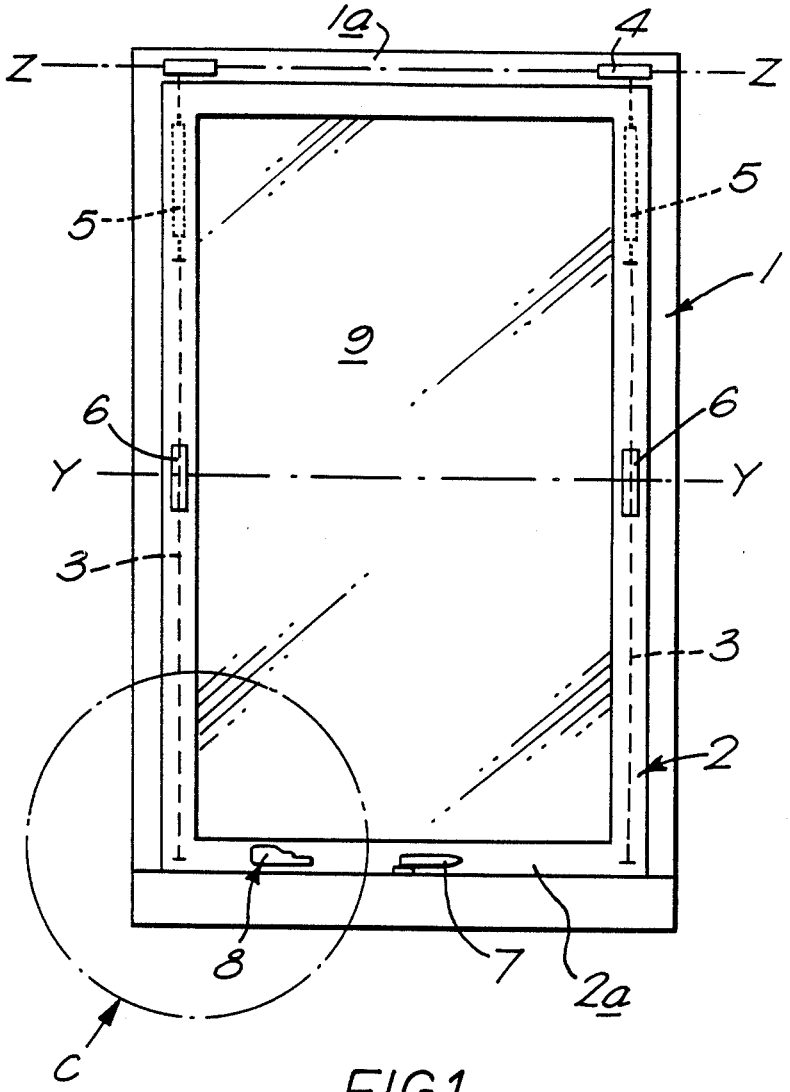
FIG. 1 is a schematic illustrative view from the inside of the structure depicting the front elevation of a simple horizontal pivot window incorporating this invention with the window being shown in the normal closed position.

With reference to FIG. 1 of the Drawings, there is depicted a schematic view of a horizontal pivot window incorporating the invention. The window comprises an outer frame 1, a sash 2, and between each side of the sash and the outer frame there extends one of two similar arms 3 (shown in dashed lines) which would each be confined within the rebate extending between the frame 1 and the sash 2. The top of each arm 3 is connected to the top 1*a* of the outer frame by a hinge 4 so that in operation the arms 3 are pivotal about the axis Z—Z as shown in FIG. 1.

On each side of the window there is one of two similar telescopic gas springs 5 (shown in dotted lines) and these are each respectively confined within the rebate when the sash is closed as shown in FIG. 1. Each gas spring 5 is secured to the top 1*a* of the outer frame and to the adjacent arm 3 so that the spring force of each gas spring 5 acts between the top of the outer frame and the arms 3 to urge the arms about the hinge axis Z—Z outwardly of the structure.

The gas springs 5 are of known kind and are telescopic struts of which the pre-load force or reaction can be predetermined and specified for the calculated weight of the sash and other components and forces.

The sash 2 is mounted for conventional horizontal pivoting movement relative to the outer frame 1 about an axis Y—Y which is substantially mid-way between the top and bottom of the frame 1. Horizontal pivot means 6 are secured to each side of the sash and to the adjacent arm 3. The sash is arranged for opening movement in known manner about the axis Y—Y, and to maintain the sash closed to the outer frame a suitable casement fastener 7 secured to the bottom rail 2*a* of the sash is provided.

As will be appreciated, the design, size and proportions of the window with the respective outer frame 1 and sash 2 can be of any suitable kind, and for installation in an inclined roof, there will be claddings or the like provided for weather cladding of the exterior of the window installation. Suitable weather-strippings or seals will be provided between the outer frame 1 and the sash 2. The sash 2 may be glazed in any suitable manner by beads or glazing strips, and the glazing unit may be of single, double or triple kinds. None of these features are described herein as they are not considered essential to this invention and the understanding thereof.

The release and subsequent movement of the arms 3 about the hinge axis Z—Z is controlled by a manually operable control member 8 mounted on the bottom rail 2*a* of the sash 2 and which is coupled to an actuator arrangement.

Generally, the emergency window system is such that the arms 3 are retained in their position close against the outer frame 1 so that the sash 2 can be opened and closed in a normal manner about axis Y—Y according to the design of the pivot means 6. On operation of the control member 8, the lower ends of the arms 3 are released so that under the force applied by the gas springs 5, the arms 3 are caused to pivot about the hinge axis Z—Z moving outwardly of the outer frame carrying the sash 2. On such movement, the entire opening 9 in the outer frame 1 is freed from any obstruction by the sash 2 which is moved clear of the opening, and the opening can be used as an emergency or escape access. After such use, the sash 2 together with the arms 3 can be returned to the closed position as shown in FIG. 1 and the arms 3 are automatically re-engaged and held back in the position for normal mode opening of the sash 2 about axis Y—Y.

A more detailed description of the construction and operation will now be given with reference to the other FIGS. of the Drawings. In the detail views of the FIGS., only one bottom corner and side of the window is depicted. It will be understood that each side and bottom corner is similar and the various component parts may be similar although of alternate handing.

A retainer 10 is secured to the rebate face 11 of outer frame 1. The retainer 10 has a base portion 12 with holes through which fixing screws 13 extend. The retainer 10 is positioned so as to lie adjacent to the lower end 3*b* of the arm 3 which extends from a cranked portion 3*a*, and mounted on the extreme end of the arm is a catch means 14 arranged to engage the retainer 10.

The catch means 14 comprises a pivot pin 15 secured to the arm 3 and about which a helical spring 16 is wound to act on a catch member 17 which is supported for limited rotation on the pivot pin 15. The catch member 17 is like a bent plate and includes an arm 18 having an end lug 19 that is arranged to engage with an upstanding striker plate 20 of the retainer 10. The striker plate 20 has an undercut face 21 extending on lower side of the retainer 10 and with which the end lug 19 co-acts. The spring 16 acts on the catch member 17 to bias the member 17 (in an anti-clockwise direction in FIG. 3 view) so that in the retaining position the end lug 19 engages under face 21.

Figure 9:
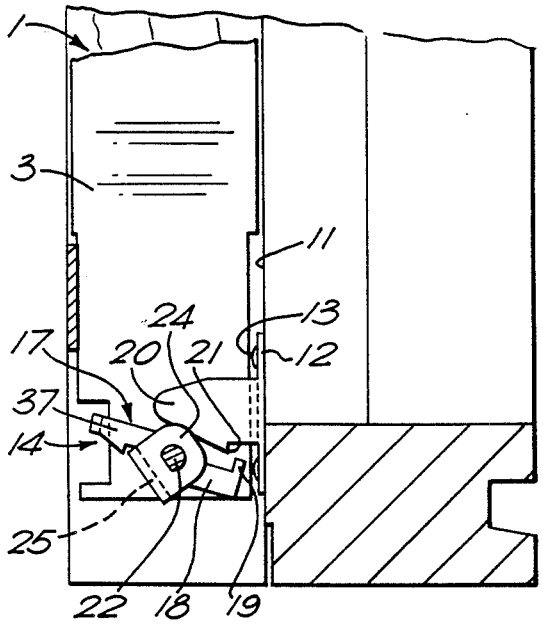
FIG. 9 is a view of the arm and retainer and catch means taken in the direction G—G as shown in FIG. 8.
Figure 10:
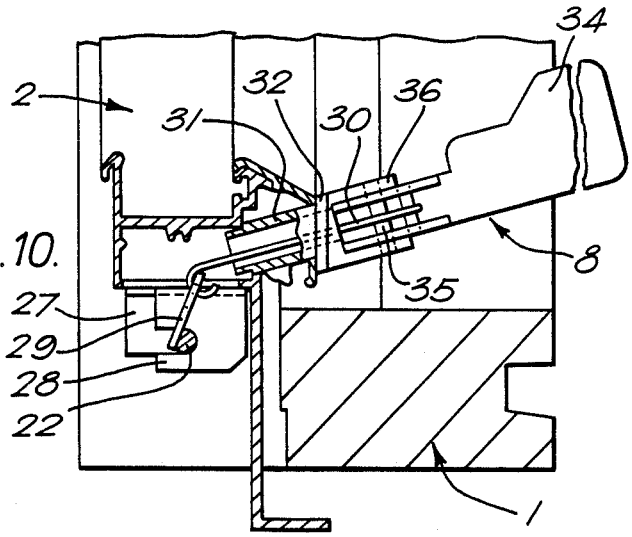
FIG. 10 is an illustrative sectional view of the actuator and control arrangement taken generally in the direction H—H as shown in FIG. 8.

The control member 8 mounted on the bottom rail 2*a* of the sash 2 is connected to an actuator arrangement including a control shaft 22 that extends longitudinally of the bottom rail terminating at each end at a position substantially aligned with the rebate of the outer frame 1. Mounted on the end of the control shaft 22 is a release abutment member 23 that is arranged to be turned with the control shaft 22. The release abutment member 23 has a mounting portion 24 secured to the end of the shaft 22 and has a lateral limb 25 of which one face is arranged on limited rotation of the shaft 22 to engage the catch member 17 as best shown in FIG. 9.

The control shaft 22 is supported for limited rotation within the sash rail and mounts a limit plate 26 with opposing limbs 27,28 extending into a limited clearance formed in the sash rail. The ends of the limbs 27,28 are arranged to engage faces of the sash rail that act as opposed limit stop positions to preclude over-turning or over-stressing of the shaft 22 and associated parts.

Attached to the control shaft 22 there is a fixed control plate 29 to which one end of a drive coupling wire 30 is connected. The coupling wire 30 extends through a guide tube 31 which is received with the sash rail and is supported thereon by a mounting boss 32 secured to the outer face of the sash rail. The guide tube 31 is provided with a flexible weatherseal such as a tubular garter (not shown) to close the throughway for the wire 30 to the sash rail. The outer end of the coupling wire 30 is connected to a cam block 33 that is mounted in the boss 32 for limited rotation by operation of the control member 8.

The control member 8 has a lever handle portion 34 in the form of a flat flag plate of which the outer face may have special wording or indication for emergency use. The control member 8 is mounted in the boss 32 for pivotal movement by a pivot pin 35 extending through a cam head 36 integral with lever handle portion 34. The cam head 36 is arranged to abut the cam block 33. A return spring (not shown) may be included in the control member assembly for restoring the member 8 to the retaining position.

Figure 4:
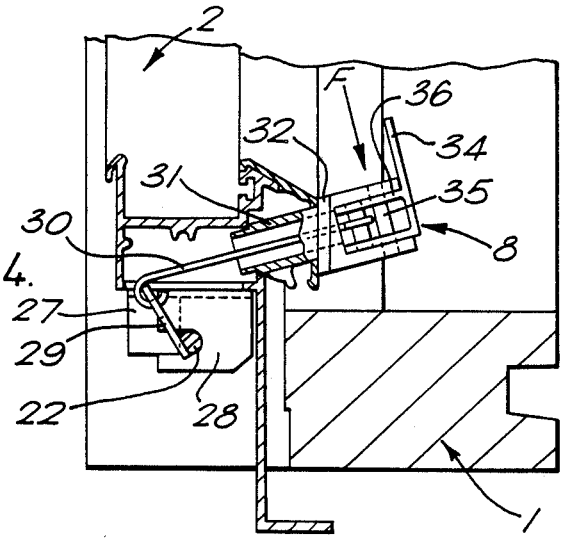
FIG. 4 is a view of the actuator and control arrangement taken in the direction B—B as shown in FIG. 2.
Figure 5:
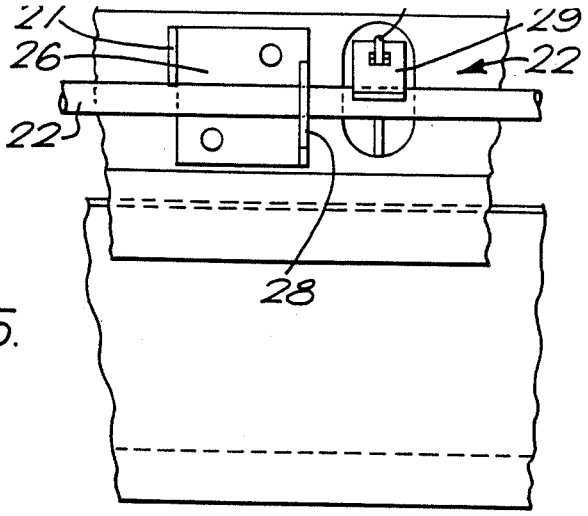
FIG. 5 is a further view of the actuator and control arrangement taken in the direction D as shown in FIG. 2.
Figure 6:
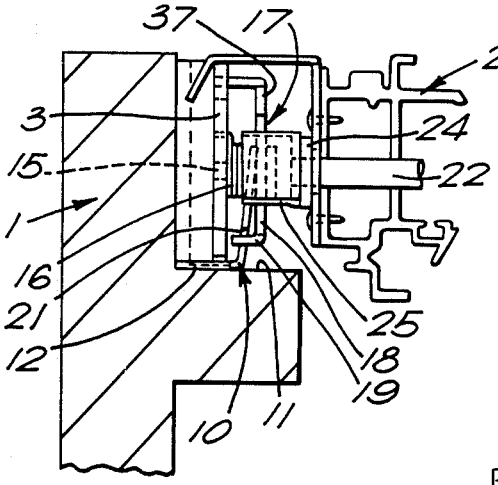
FIG. 6 is a further view of the retainer and catch means and associated parts taken in the direction E as shown in FIG. 2.
Figure 7:
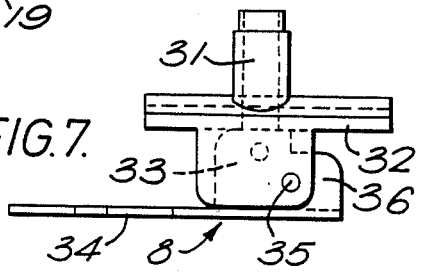
FIG. 7 is a detail enlarged view of part of the control member and actuator arrangement taken in the direction F as shown in FIG. 4.

In FIG. 4 the control member 8 is shown in the retaining or non-operative position in which the lever handle portion 34 extends parallel to the outer face of the sash rail. On pulling the lever handle portion 34 outwards of the sash rail, the cam head 36 rotates relative to the cam block 33 and drives the cam block 33 to pull on the drive coupling wire 30 connected to the control shaft 22 through the control plate 29. Thus, by pulling on the lever handle, the control shaft 22 is caused to rotate from one extreme position to the other.

Figure 2:
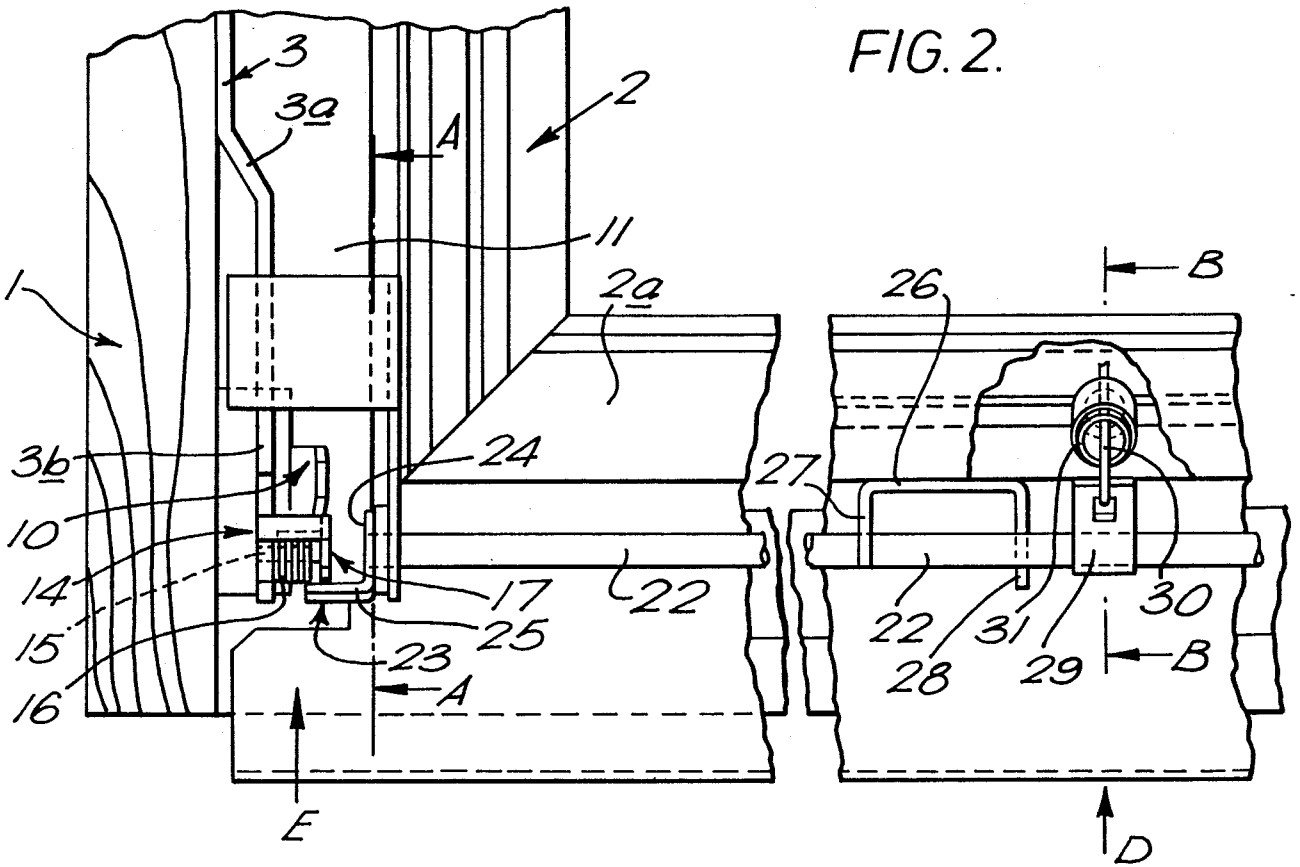
FIG. 2 is a detail view of the lower left hand portion of the window as encircled C in FIG. 1, the view being a front plan view with sections being broken away for clarity and the component parts being shown in the normal closed and retained position.
Figure 3:
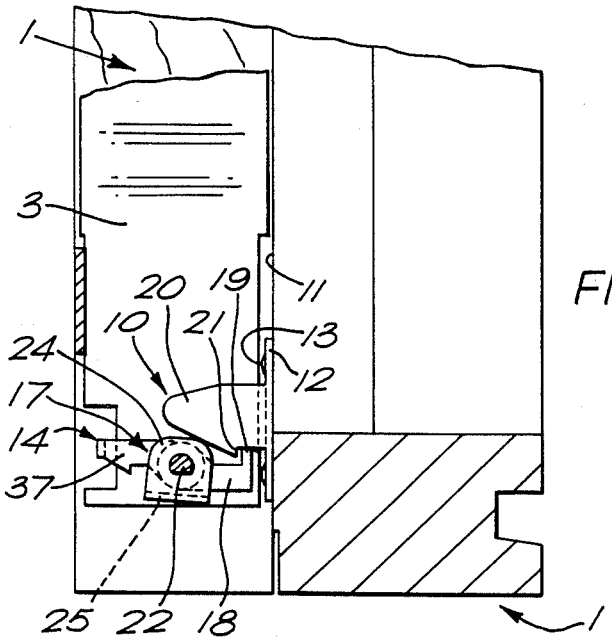
FIG. 3 is view of the arm and retainer and catch means taken in the direction A—A as shown in FIG. 2.
Figure 8:
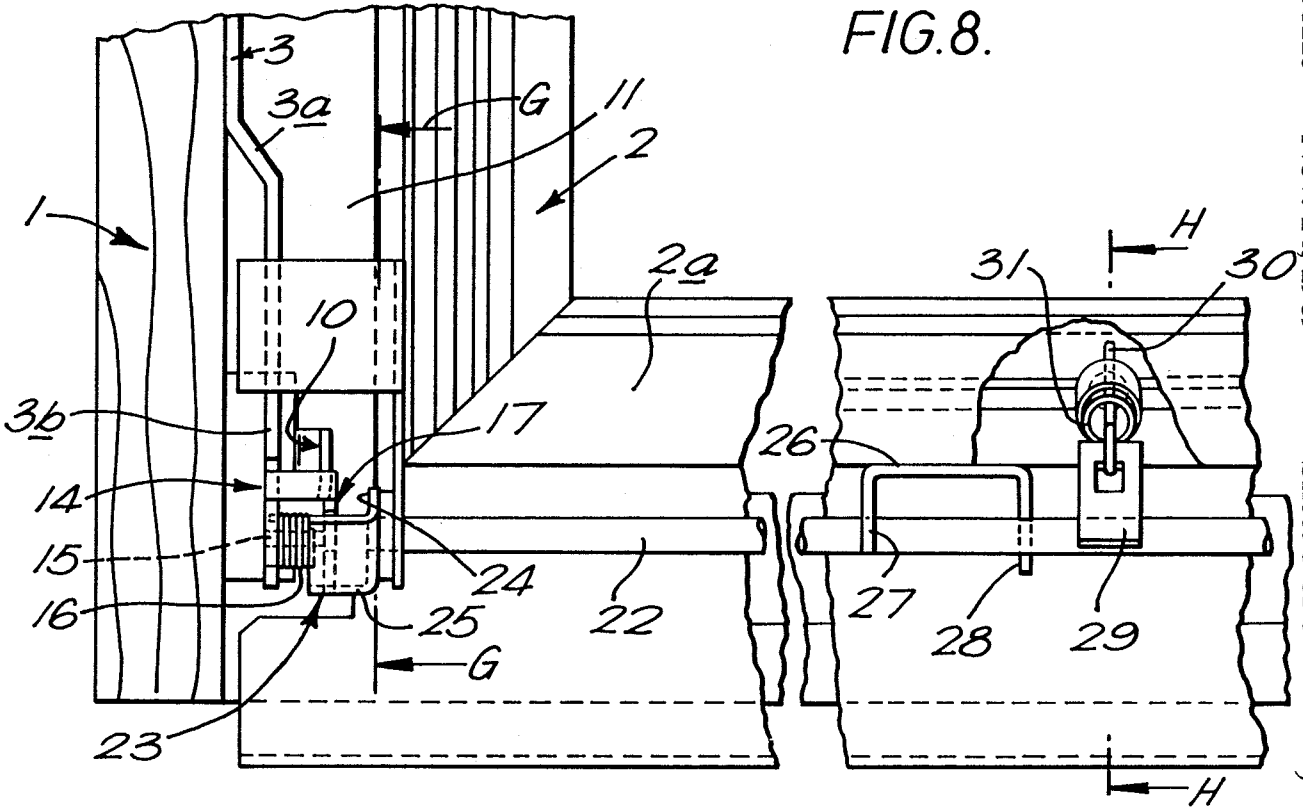
FIG. 8 is a view similar to that of FIG. 2 but shown in the relative positions for disengagement of the catch means with the retainer.

In operation of the window system, reference is now made to FIGS. 2 and 3, and to FIGS. 8 and 9 which show respectively, the relative positions of the control shaft 22, the catch means 14, and the retainer 10 for the retained position of the arm 3 and the released position in which the arm 3 is free to move under the influence of the gas springs 5.

As seen in FIGS. 2 and 3, the control shaft 22 is in one of its limit position and the release abutment member 23 is clear of the catch member 17. The end lug 19 of the catch arm 18 is engaged with the striker 20 under the face 21 and is biassed into this retaining position by the helical spring 16. The arm 3 is thereby retained in this position, and the sash can be opened and closed in the normal manner using the casement fastener 7.

By turning the control shaft 22 into the other extreme position by the control member 8, the release abutment member 23 is moved into the release position as seen in FIGS. 8 and 9. The lateral limb 25 of the abutment member 23 is brought into engagement with a control arm 37 of the catch member 17 which extends opposite to the catch arm 18. On such engagement, the catch member 17 is caused to rotate against the spring bias and the end lug 19 of catch member 17 is disengaged from the retainer 10. On such disengagement, the lower end of the arm 3 is free to move away from the rebate of the frame and is no longer constrained.

Once the catch means 14 has been disengaged from the retainer 10, the helical spring 16 restores the catch member 17 into an operative position so as to automatically re-engage the retainer when the arm 3 is returned into the rebate. The cam action with any spring assistance of the control member 8 also returns the lever handle portion 34 back to the inoperative position restoring the control shaft 22 with the release abutment member 23 into the required position for further actuation and operation.

When the catch means 14 is disengaged from the retainer 10, the catch member 17 is rotated by the spring 16 into the operative position as just explained. However, in this position (not shown) the free end of the control arm 37 engages with part of the sash so as to secure the sash 2 to the arm 3 so that the sash 2 cannot pivot relative to the arms 3.

It will be understood that on the operative release of the ends of each of the arms 3, the sash is carried by the arms as these are displaced by the gas springs away from and out of the opening 9 of the outer frame 1 leaving such opening for use as an emergency or escape access.

It will be appreciated that such emergency means of escape is incorporated in a window which can be used for normal operation at any time, but in the event of an emergency, the casement fastener 7 is first opened and then the lever handle of the control is pulled to release the arms 3 as explained. The sash can be returned to the normal mode of use by closing the sash into the outer frame with the automatic re-engagement of the catch means with the retainer.

In this exemplary embodiment, each of the arms 3 extends from the top to the bottom of the rebate in the outer frame, and there are opposed retainers 10 and corresponding catch means on each end of the control shaft. It is envisaged that for certain types and sizes of windows, it is not essential for two such full length arms, and there could be just one long arm and one retainer for co-operation with a release abutment member mounted on the appropriate end of the control shaft. The pivot means would be secured to this long arm as described previously, and the opposed pivot means can be supported from a short arm hinged to the top of the outer frame but without having the lower portion extending beyond the pivot means. Such an arrangement is not preferred for reasons of symmetry, load and force distribution as well as assembly simplicity. However, the concept of this invention can be applied or used for special applications.

It is also envisaged that a different form of control member or operating handle could be used, and in this regard the design and type of operating actuator might be especially constructed and designed for emergency and fire hazard applications.

The actuator or control member could be connected by a suitable loss motion drive to open a suitable casement fastener automatically when the control member is used for the emergency.

Other design and aesthetic requirements may necessitate a special configuration and appearance of the control member or operating handle, but a wide range of suitable drive couplings to drive the control shaft can be utilised within the scope of this invention.

By this exemplary construction for the window system, it will be understood that the same basic components can be used for a wide range of windows. The arms may be to the desired length to suit the height of the window and the control shaft can be made to the width of the window. All of the other components can be common to various sizes, and economies in manufacture and assembly are obtained by such construction.

Various engineering changes may be required for window systems of different profile or materials, but these are also considered within the scope of this invention.

I claim:

1. A window comprising an outer frame for securing to a structure, a sash mounted by opposed pivot means for pivotal movement about a horizontal axis relative to said outer frame, the horizontal pivot axis lying intermediate the top and bottom of said outer frame, two opposed arms supported from said top of the outer frame with each said arm extending alongside a respective side member of said outer frame for confinement within the rebate between said outer frame and said sash when the sash is closed, each said arm being supported at its upper end by a hinge mounted on said outer frame, spring means acting between said outer frame and said arms to urge said arms in a direction outwards of said outer frame, a retainer mounted on said outer frame for engagement with catch means on the lower end of at least said arm to retain the arms alongside the respective side member of said outer frame against the force of said spring means to preclude pivotal movement of said arms about their respective hinges, said opposed horizontal pivot means being connected to said sash and to said arms whereby when said retainer is so engaged with said catch means said sash can be opened and closed relative to said outer frame in a normal mode pivoting about said intermediate horizontal axis, and an actuator mounted on said sash for disengaging said catch means from said retainer whereby said arms are released for hinged movement about their upper ends under the force of said spring means to displace said arms with said sash outwardly clear of the opening in said outer frame in which said sash seats when in the closed position.

2. A window according to claim 1 wherein said spring means acting on said arms is a telescopic gas spring which is confined within said rebate between said outer frame and said sash and which gas spring when extended, provides an elongate strut assembly for supporting said arms and said sash.

3. A window according to claim 2 and wherein each of said arms is arranged to extend the full length of each said respective rebate, and each said arm has associated catch means for engagement with an associated retainer mounted on said outer frame.

4. A window according to claim 3 wherein each said arm is of elongate plate form of which said top end portion is connected to said hinge secured to said top of said outer frame so that the hinging axis of said arms extends horizontally aligned with said top of the outer frame.

5. A window according to claim 1 wherein said retainer on said outer frame comprises a fixed striker plate upstanding from said outer frame and lying adjacent to lower end of the arm and said catch means comprises a catch plate mounted on said lower end of the arm for engagement with the striker, said catch plate being arranged for releasing movement away from said striker for disengagement and release of said arm when said actuator is operated.

6. A window according to claim 5 wherein said catch plate is mounted for pivotal movement on said lower end of said arm and is spring-loaded so as to be biassed into engagement with said striker and wherein said actuator is arranged to act on said catch plate to overcome such spring bias and to pivot said catch plate in a direction to disengage it from said striker.

7. A window according to claim 6 wherein a casement fastener is fitted to the window for normal mode closingand securing of said sash to said outer frame when said sash is in the closed position.

8. A window according to claim 7 wherein said actuator mounted on said sash includes a manually operable control member which is separate from said casement fastener.

9. A window according to claim 8 wherein said actuator comprises a control shaft extending lengthwise of said bottom sash member and arranged for limited rotation on operation of said control member, and said control shaft mounts a release abutment for engagement with said catch plate of said catch means for displacing said catch plate into the release position when the control shaft is rotated by operation of said control member.

10. A window according to claim 9 wherein said manually operable control member includes a lever handle arranged to rotate said control shaft through a drive connection comprising a cam return arrangement whereby said control member and said control shaft are automatically returned to the operative retaining position after operation.

* * * * *